US006336429B1

(12) United States Patent
Wiener et al.

(10) Patent No.: US 6,336,429 B1
(45) Date of Patent: Jan. 8, 2002

(54) DRUMLESS NATURAL CIRCULATION BOILER

(75) Inventors: Murray Wiener; Ernst H. Mayer, both of Akron; Melvin J. Albrecht, Columbiana County, Knox Township, all of OH (US)

(73) Assignee: The Babcock & Wilcox Company, New Orleanse, LA (US)

( * ) Notice: Subject to any disclaimer, the term of this patent is extended or adjusted under 35 U.S.C. 154(b) by 0 days.

(21) Appl. No.: 09/585,878

(22) Filed: Jun. 1, 2000

(51) Int. Cl.[7] ..... F22B 37/26
(52) U.S. Cl. ..... 122/488; 122/6 A
(58) Field of Search ..... 122/1 B, 1 C, 122/6 A, 406.5, 488, 489, 491, 235.15

(56) References Cited

U.S. PATENT DOCUMENTS

| | | | | |
|---|---|---|---|---|
| 3,788,282 A | * | 1/1974 | Modrak et al. | 122/491 |
| 4,262,636 A | * | 4/1981 | Ausburger | 122/1 B |
| 4,290,389 A | * | 9/1981 | Palchik | 122/406.5 |
| 5,713,311 A | * | 2/1998 | Fitzgerald | 122/6 A |

OTHER PUBLICATIONS

Steam/its generation and use, 40$^{th}$ Editon, Copyright ©1992, The Babcock & Wilcox Company, pp. 5–1, 5–16 to 5–18, and 18–1 to 18–4.

Steam/its generation and use, 40$^{th}$ Edition, Copyright ©1992, The Babcock & Wilcox Company, pp. 18–18 to 18–23.

Fig. 1, Vertical Separator with Flat Head.

Fig. 2, Long Vertical Separator.

* cited by examiner

*Primary Examiner*—Gregory Wilson
(74) *Attorney, Agent, or Firm*—Eric Marich

(57) ABSTRACT

A drumless natural circulation boiler system has a furnace enclosure with wall tubes and upper and lower headers connected to respective upper and lower ends of the wall tubes. At least one tangential steam/water separator is connected to a plurality of riser tubes that are also connected to the upper headers. The riser tubes return a steam/water mixture to the separator. Each riser tube is connected to the separator at a tangential nozzle for swirling the steam/water mixture in the separator for separating steam from water in the separator. At least one saturated connecting tube is connected to the separator for conveying steam therefrom. A downcomer is connected to the separator for conveying water from the separator and a plurality of supply tubes are connected between the downcomer and the lower headers. The separator includes a vertically extending cylindrical enclosure and a feedwater conduit is connected to the separator for supplying feedwater to the separator.

16 Claims, 7 Drawing Sheets

DRUMLESS NATURAL CIRCULATION BOILER

FIELD AND BACKGROUND OF THE INVENTION

The present invention relates generally to large commercial utility boilers or steam generators and, in particular, to a new and useful natural circulation steam generator which uses a plurality of large diameter vertical pressure vessels at the top of downcomers of the steam generator, instead of a conventional single large steam drum.

A conventional natural circulation boiler or steam generator system, generally designated 10, is schematically illustrated in FIG. 1. The system 10 comprises a steam drum 12, downcomers (DC's) 14 provided with downcomer bottles (DCB's) 15 at a lower end thereof, supply tubes 16, furnace wall tubes 18, riser tubes 20 and steam/water separators 22 inside the steam drum 12. Typically, heated feedwater 24 enters the drum 12 via a feedwater distribution system whose task it is to thoroughly mix the feedwater 24 with the saturated water in the steam drum 12 which has been separated from the steam-water mixture supplied to the separators 22 in the steam drum 12 via the riser tubes 20.

The resulting water mixture (usually subcooled, i.e., the temperature of the water is below the saturation temperature corresponding to the operating pressure within the steam drum 12) enters and flows down through the downcomers 14 and is distributed, via a number of supply tubes 16, to inlet headers 26 of the furnace circuits, e.g. the wall tubes 18.

Circulation of the water in the furnace circuits or wall tubes 18 (also shown in the FIGS. as front wall (FW), side walls (SW's), and rear wall (RW), is established through the difference in fluid density between the subcooled water in the downcomers 14 and the steam/water mixture in the heated furnace circuits 18. The fluid velocity in the wall tubes comprising the furnace circuits must be sufficient to cool the furnace wall tubes 18, which are typically exposed to combustion gases B whose temperature may reach 3500° F. in the burner zone 28 of the furnace.

As soon as the heated fluid reaches saturation conditions, steam begins to form and the fluid within the wall tubes 18 becomes a two-phase mixture. The fluid velocity must be sufficient to maintain nucleate boiling (bubble-type boiling) within the tubes 18, as this is the regime which generates the highest possible heat conductance, i.e. the best cooling between the fluid within the tubes 18 and the inside wall of the tubes 18 on the heated (furnace) side. Insufficient fluid velocity in combination with high heat flux and an excessive percentage of steam in the steam-water mixture leads to steam blanketing on the inside of the tubes 18. This is equivalent to an insulating-type steam film along the heated, inside tube wall, which causes rapid tube failure. The danger of film boiling increases with increasing boiler pressure. The fluid temperature in the boiling (two-phase) regime is strictly dependent on the local internal pressure and is nearly constant from the point where boiling starts to the point where the saturated water leaves the separators.

The steam-water mixture eventually reaches outlet headers 30 of the furnace circuits 18. From here, the steam-water mixture is conveyed to the steam drum 12 and distributed along a baffle space therein and from there to a plurality of steam/water separators 22 located inside the steam drum 12.

The steam/water separators 22 separate the saturated water from the saturated steam, usually through centrifugal force generated through either tangential entry of the two-phase fluid into cyclones or through stationary propeller-type devices. The centrifugal action literally "squeezes" the steam out of the steam-water mixture.

The saturated steam leaves the top of the steam drum 12 through saturated connecting tubes 32 which supply the steam to the superheater(s) 34 of the boiler or steam generator system 10, where the steam is further heated to the desired final temperature before being sent to a turbine or a process. The saturated water, as stated earlier, leaves the bottom of the steam/water separators 22 and mixes with the continuously supplied feedwater.

The crucial element in a conventional steam generator or boiler circulation system 10 is the steam drum 12. In high-pressure boilers with natural or pump-assisted circulation, such steam drums 12 may be over 100 feet long, with a 6 foot inside diameter, and shell thicknesses over 7 inches. Thus, the steam drums 12 are very large and extremely heavy and must be lifted in place as soon as the boiler and its structural steel and columns are erected, prior to erecting all other boiler pressure parts. Accordingly the steam drum 12 is on the critical path of the overall schedule for such boiler and power plant projects. For a more detailed description of conventional steam generators and steam drums as generally described above, the reader is referred to the 40th edition of *Steam/its generation and use*, 40th Edition, Copyright© 1992, The Babcock & Wilcox Company.

SUMMARY OF THE INVENTION

Elimination of large steam drums in favor of reduced size separating vessels, according to the present invention, is the logical consequence of a steady reduction in the so-called Circulation Ratio. The Circulation Ratio (CR) is defined as (total water flow to the furnace circuits/steam flow to the superheater). For many years, the minimum CR for natural (or pump-assisted) circulation high pressure (>2500 psig drum operating pressure) boilers was 4.0. However, the invention and successful introduction of multi-lead ribbed furnace tubes made it possible to reduce the CR, as ribbed tubes can safely operate at much lower water flow rates than internally smooth tubes exposed to furnace heat. Therefore, the drumless boiler concept according to the present invention becomes economical at CR's below 3.0.

At the low end of the CR spectrum would be the types of steam generators known as subcritical once-through boilers which have a CR of 1.0 and—typically no separating equipment, except perhaps that used for removal of residual moisture. The present inventors believe, therefore, that it is only logical that with decreasing CR, a natural (or pump-assisted) circulation boiler design should more and more resemble a once-through subcritical boiler. As the following description of the drumless natural circulation boiler concept will demonstrate, this philosophy, and its attendant benefits, is realized by the present invention. As experience with the new type of drumless natural circulation boiler design becomes available, the present inventors believe that the future trend will be towards ever-decreasing CR's, since lower CR's require fewer and smaller, and therefore less expensive, connections (supply tubes, riser tubes, downcomers, etc.) and steam/water separators in the circulation system of such boilers.

An object of the present invention is to provide a drumless natural circulation boiler system. A crucial difference between such a system and a conventional natural circulation system with steam drum is that the single large steam drum is eliminated and the tops of the downcomers are modified into large vertical steam/water separators in the form of large diameter, vertically extending vessels. Phase separation is achieved through a suitable number of tangential nozzles which lead the steam-water mixture from the riser tubes into the separators where the saturated steam is separated from the steam-water mixture through centrifugal action along the separator's cylindrical inside periphery. The nozzles must be suitably inclined against the horizontal plane to avoid interference between the multiple fluid jets. The tangential velocity is a function of the total flow to each separator, the boiler pressure, the number and size of the nozzles, the allowable pressure drop across the separators, and the inside diameter of the separators, and must be sufficient to effect separation, like in other types of separators. Preferably, the upper portion of the vertical steam/water separators is provided with an internal arrangement of vertical scrubber elements arranged around the inside perimeter of the vertical steam/water separators and through which the steam is conveyed to remove a significant portion of any water remaining in the steam.

Accordingly, one aspect of the present invention is drawn to a drumless natural circulation boiler system. The system comprises a furnace enclosure having wall tubes, and upper and lower headers connected to respective upper and lower ends of the wall tubes. At least one vertical steam/water separator is provided, and riser means are connected between the upper headers and the separator for returning a steam/water mixture to the separator, the riser means being connected to the separator for swirling the steam/water mixture in the separator for separating steam from water in the separator. Saturated steam connection means are connected to the separator for conveying saturated steam therefrom. A downcomer is connected to the separator for conveying water from the separator, and supply means are connected between the downcomer and the lower headers for conveying water thereto.

Another aspect of the present invention is drawn to the vertical steam/water separator itself. The vertical steam/water separator comprises a vertically extending cylindrical vessel having a top and a bottom portion. Means are provided for introducing a steam/water mixture to the vessel for swirling the steam/water mixture in the separator for separating steam from water in the separator. Vertically oriented scrubber means remove water from steam, and are located in the top portion of the vessel and arranged around an inside circumference of the separator. Saturated steam connection means convey saturated steam from the vessel, feedwater supply means convey feedwater to the vessel, and means are provided for conveying the feedwater and water separated from the steam from the vessel.

Yet another aspect of the present invention is drawn to a steam/water separator for a boiler which receives feedwater and a steam/water mixture, separates the steam from the water, conveys the separated steam from the separator, and mixes the feedwater with the separated water and conveys both from the separator. The separator comprises a vertically extending cylindrical vessel having a top and a bottom portion and defines a plurality of zones therein, each zone having a particular function. The zones include a secondary steam/water separation zone having scrubber means for removing a final portion of water from the steam. An entrainment separation zone is located below the scrubber means and above a boiler steam/water entry zone, the latter providing the steam/water mixture into the separator via a plurality of inclined tangential nozzles. A primary steam/water separation zone, located below the boiler steam/water entry zone, is where water spirals downwardly to the bottom of the separator. A vertical separator water level operation zone is located below the primary steam/water separation zone. This zone will be substantially filled with water having a fluctuating water level during boiler operation. A feedwater injection zone, located below the vertical separator water level zone, defines where the feedwater is introduced into the separator for mixing with the separated water. Finally, a lower vortex elimination zone, located below the feedwater injection zone, performs the function of reducing rotation of the feedwater and water as it is conveyed from the separator.

Advantages of the drumless natural circulation boiler design include the fact that the separators/downcomers will be straight, can be placed optimally around a furnace, and can be erected at a later stage, rather than immediately after erection of the boiler support frame. The cost for material, fabrication, shipping, and erection for separators is considerably less than for drums of equal capacity.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
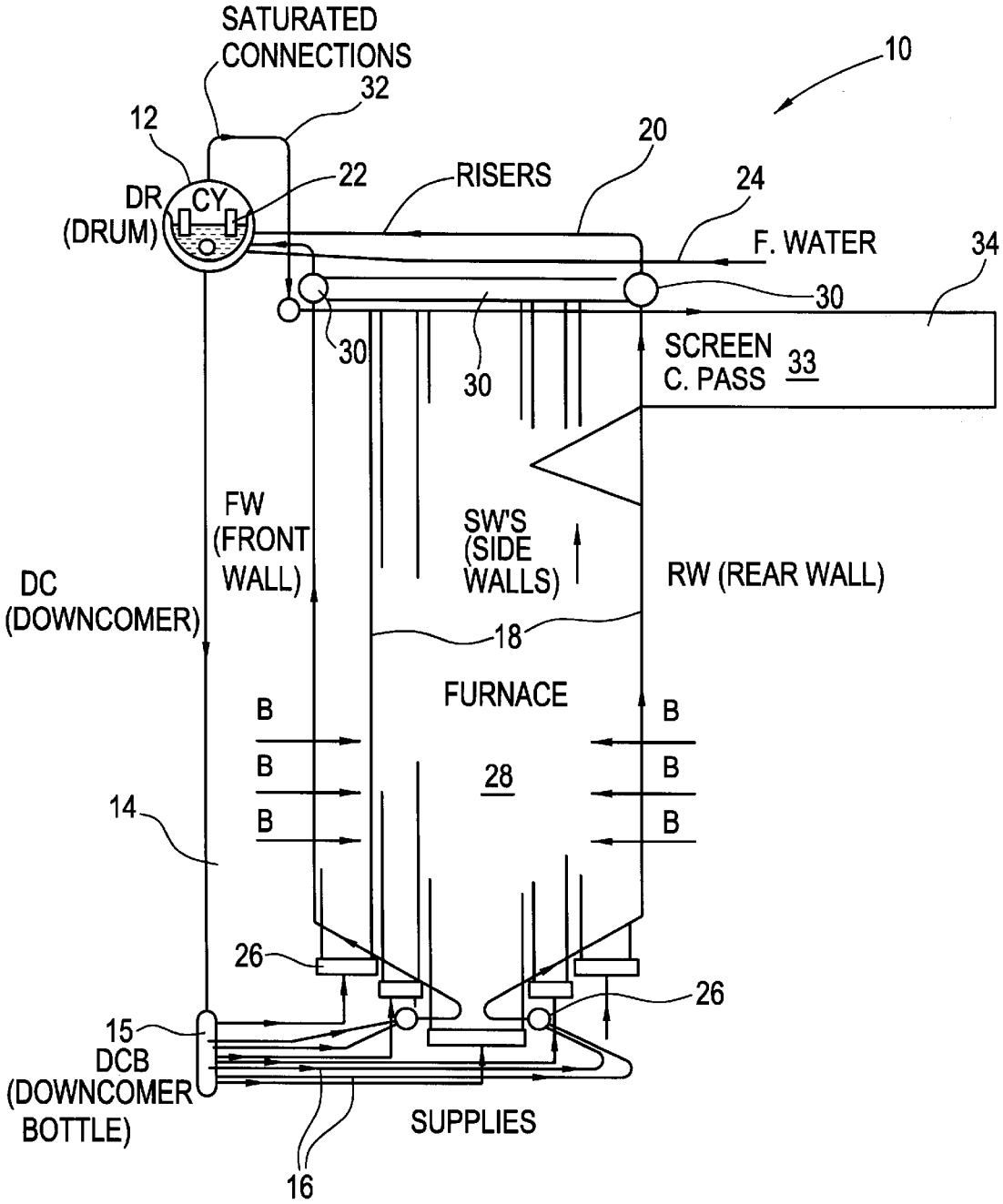
FIG. 1 PRIOR ART
FIG. 1 is a schematic diagram showing a conventional natural circulation boiler system with a single steam drum.
Figure 2:
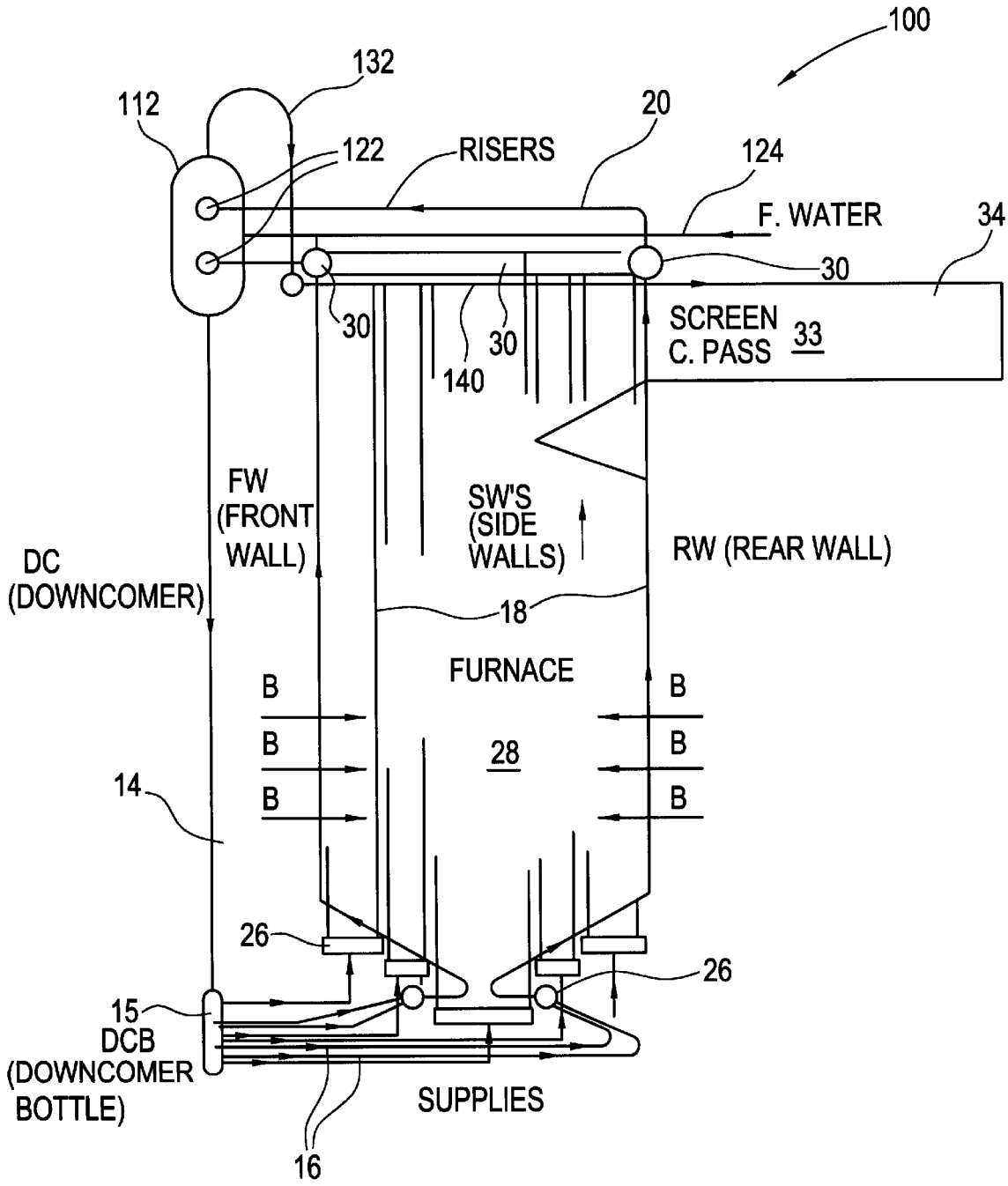
FIG. 2 is a view similar to FIG. 1 of a drumless natural circulation boiler according to the present invention.
Figure 3:
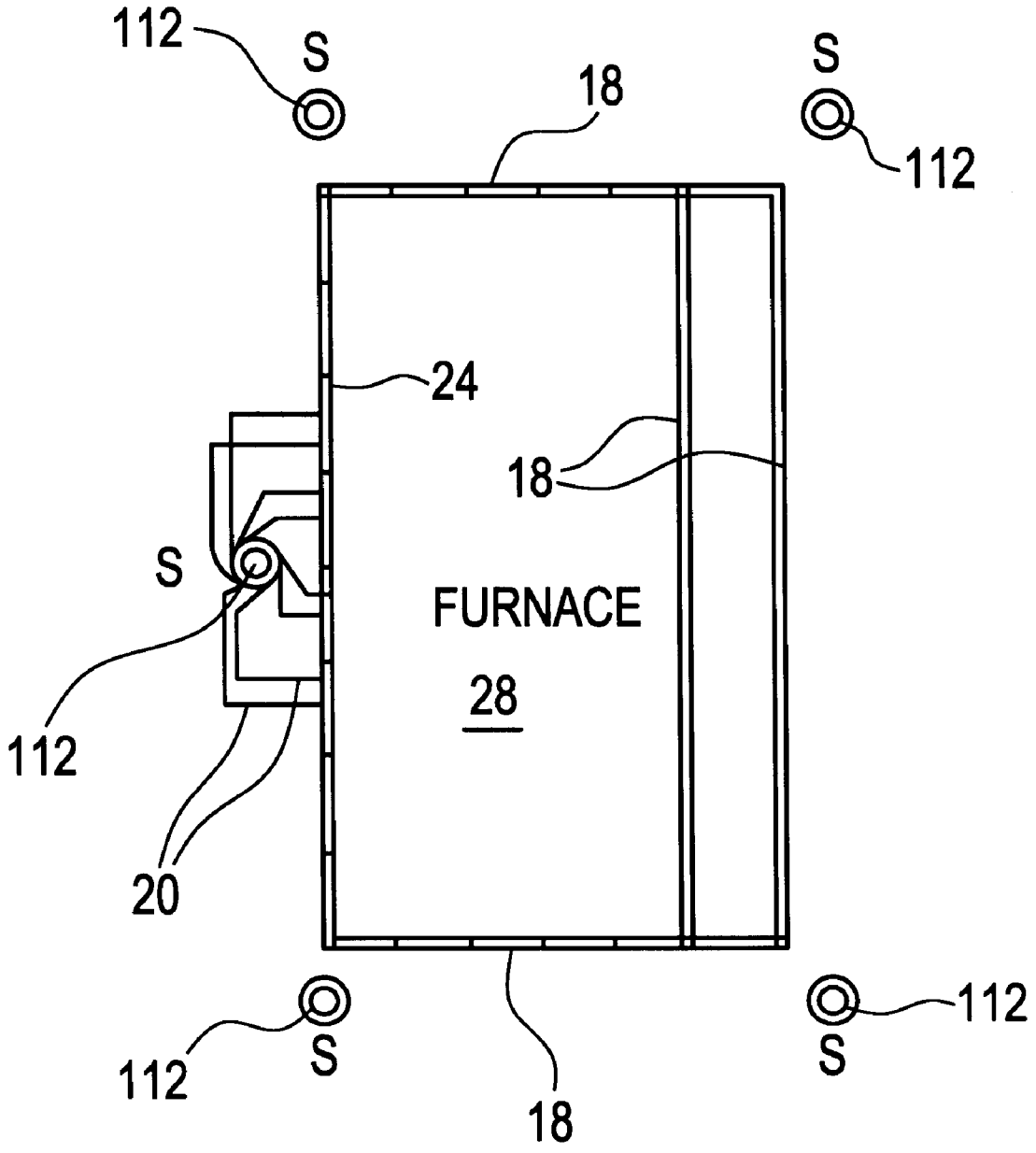
FIG. 3 is a top view of the drumless natural circulation boiler of FIG. 2, illustrating how the vertical steam/water separators according to the invention may be located as required around a periphery of a furnace of the boiler or steam generator.
Figure 4:
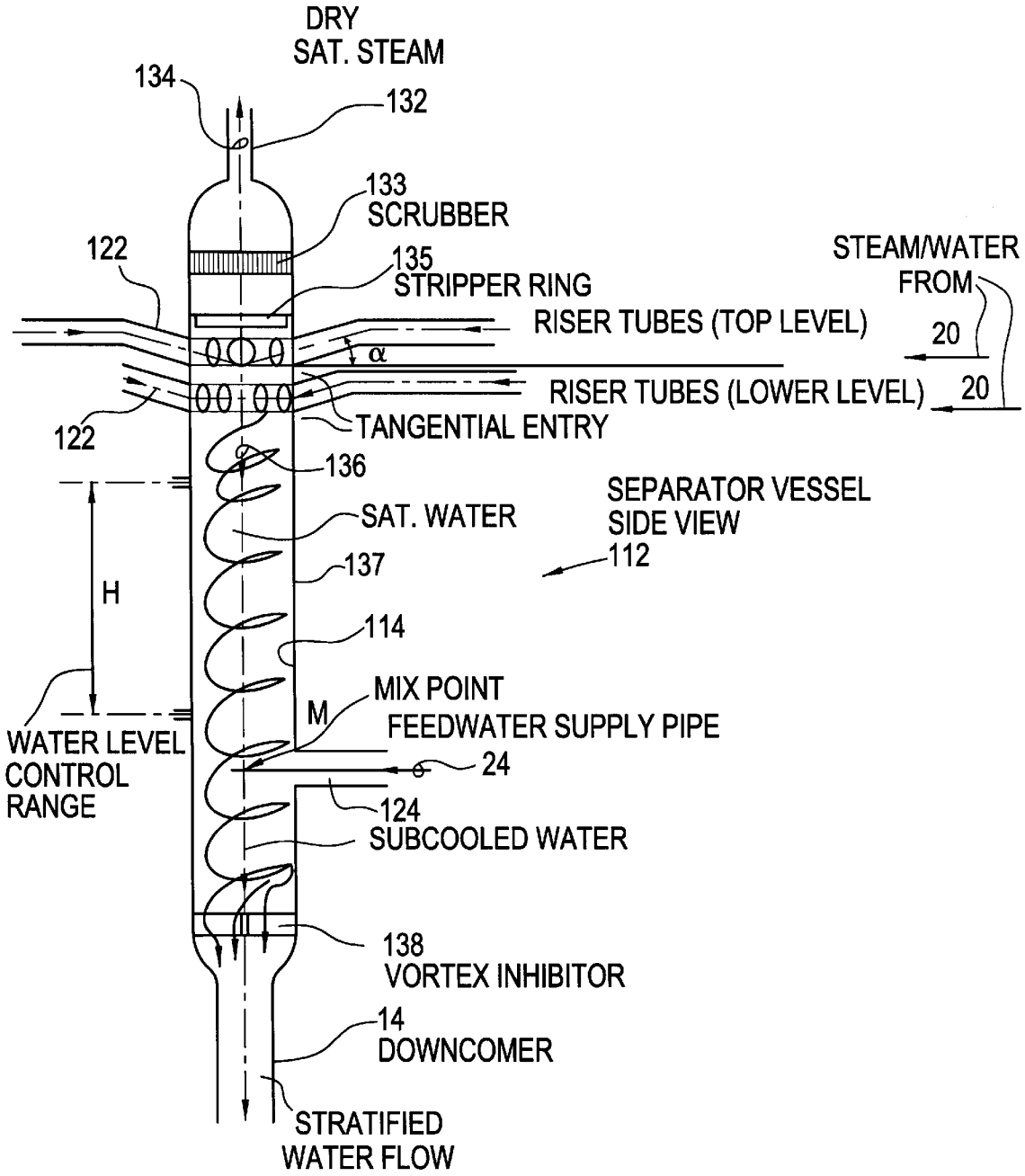
FIG. 4 is a sectional side view of one embodiment of a vertical steam/water separator according to the invention.

Referring to the drawings generally, in which like reference numerals designate the same or functionally similar elements throughout the several drawings, and to FIGS. 2, 3 and 4 in particular, there is shown schematically the principle of a drumless natural circulation boiler and circulation system according to the present invention, generally designated 100. It will be appreciated by those skilled in the art, that the term "natural circulation boiler" includes both pure natural circulation boiler designs wherein circulation of the fluid in the furnace enclosure walls is accomplished solely by differences in density of the fluid in the furnace walls and the fluid in the downcomers, and pump-assisted designs which employ pumps in such fluid circuits to assist in the circulation of the water and steam/water mixture.

As noted above, a crucial difference between such conventional natural circulation boiler or steam generator systems and the present invention is that in the latter, the top of each of the downcomers 14 is modified into large steam/water separators (S) 112 (FIG. 4). Phase separation is achieved through a suitable number of tangential nozzles 122 which lead the steam-water mixture from the riser tubes 20 into the separators 112 where the saturated steam is separated from the steam-water mixture by centrifugal action along the cylindrical inside periphery 114 of the separator vessels 112. The nozzles must be suitably inclined against the horizontal plane to avoid interference between the multiple fluid jets. The angle of inclination, $\alpha$, is preferably 15°, but the actual value may be adjusted in certain circumstances. The tangential velocity is a function of the total flow to each separator 112, the boiler pressure, the number and size of the nozzles 122, the allowable pressure drop across the separators 112, and the inside diameter of the separators 112 and must be sufficient to effect separation, like in other types of separators.

The separator design is conceptually shown in FIG. 4. While in each separator 112, saturated steam 134 leaves through connections 132 at the top of the separator 112, as illustrated in FIGS. 2 and 4, while the separated, saturated water 136 flows downward to a lower portion of the steam/water separator 112 and is in rotation imparted through the centrifugal action at the top. The saturated steam 134 preferably passes through a scrubber element 133 at the upper portion of the separator 112 to ensure as dry saturated steam as possible; a stripper ring 135 may also be employed in the upper portion of the separator 112 to prevent water swirling around the inside perimeter of the walls 137 of the separator 112 from being entrained in the exiting saturated steam 134. Feedwater 24 provided via conduits 124 enters the separator 112 at a lower point and mixes with the saturated water at a mix point or region M before flowing downwardly across vortex inhibitors 138, such as baffles, into the actual downcomer 14. Due to the smaller water inventory in the separator 112, compared with that in a conventional single steam drum 12, the water level control range H in the separators 112 must be over a much greater height difference than in a conventional drum 12 (e.g.,±6 feet compared with typically ±6 inches).

Because of this aspect, according to the present invention the principle of drumless natural circulation boilers is restricted to those boilers large enough (i.e., with sufficiently large distances between the separators 112 and the lower furnace headers) to allow such fairly substantial water level (i.e., "pumping head") variations without significantly affecting the flow velocity in the furnace circuits. Also, the most effective application of the principles according to the present invention can be expected in connection with large, high-pressure (>2500 psig drum operating pressure) steam generators or boiler units, using internally rifled or ribbed furnace tubes capable of operating safely at relatively low internal flow velocities, compared with internally smooth tubes normally used in low-pressure (<2200 psig drum operating pressure) applications.

As illustrated in FIG. 3, it will be seen that the vertical steam/water separators 112 according to the present invention may be easily located around the perimeter of the furnace 28. This permits the lengths of individual supply tubes and riser tubes 20 to be optimized or routed to avoid interference with existing structural steel or other equipment associated with the steam generator 100. This flexibility becomes extremely important in situations where major steam generator repairs, modifications, or conversions are being contemplated.

Figure 5:
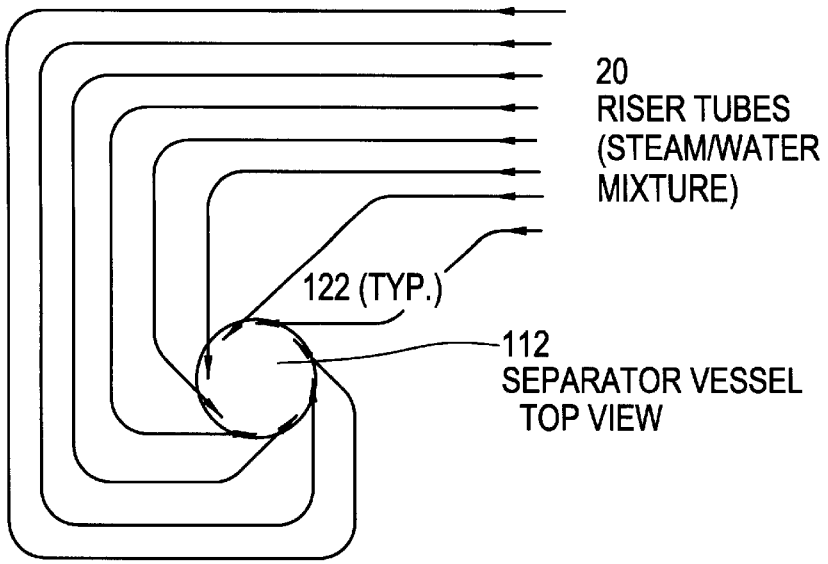
FIG. 5 is a schematic plan view of an individual vertical steam/water separator and how riser tubes connected thereto might be arranged.
Figure 6:
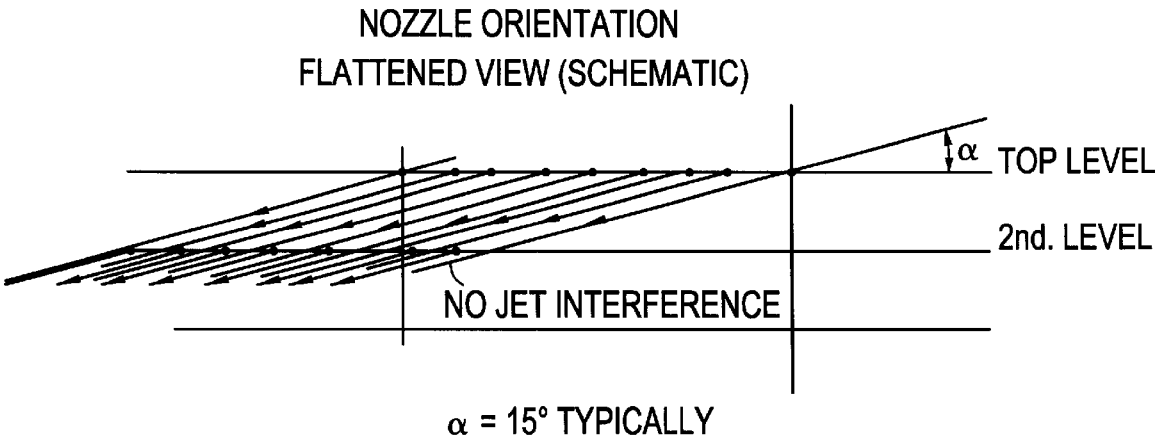
FIG. 6 is a schematic, flattened view of the outside perimeter of the vertical steam/water separator of FIG. 5 illustrating how the riser tubes in one level are oriented and staggered with respect to riser tubes in an adjacent level.

Returning now to FIG. 4, and next to FIGS. 5 and 6, the steam/water separator 112 is of a compact, efficient design. The steam/water mixture enters near the top of the separator vessel 112 through the riser tubes 20 through a plurality of nozzles 122, which are tangentially arranged around the periphery of the vessel 112, at one or possibly more levels (FIG. 5). The tangential entry is designed to create the formation of a rotating vortex of the steam/water mixture. The rotating vortex provides the centrifugal force needed to separate the steam from the water. FIG. 5 shows a top view of a vertical separator 112 and the tangential entry of riser nozzles 122 into the vessel 112. The nozzles 122 are inclined downward (typically 15 degrees) to use gravity which promotes the water flow downwards. This inclination also avoids interference between the jets coming from the plurality of nozzles 122. If more than one level of nozzles 122 is required, it becomes imperative to avoid interference between the jets from the various levels. This can be achieved through proper staggering of the nozzle 112 locations at different levels, as indicated in FIG. 6, which is a schematic, flattened view of the outside perimeter of the vertical steam/water separator 112 of FIG. 5 illustrating how the nozzles 122 for riser tubes 20 in one level are oriented and staggered with respect to the nozzles 122 for riser tubes 20 in an adjacent level. While two levels are illustrated, it is possible to have fewer or greater numbers of levels. The number depends upon a combination of factors, some being functional in nature such as the amount of steam/water mixture being delivered to a given separator 112, others being structural in nature, such as the wall thickness and efficiency of the ligaments between adjacent nozzle penetrations on a given separator 112. This also forces the optimal separation of steam from the water through centrifugal action along the vessel inside wall.

The steam, which is at saturation condition, i.e., dry, but not superheated, is driven upward by the stripper ring 135 and through a torturous path (e.g., corrugated plate array) scrubber 133 which remove practically all residual moisture and droplets. Essentially dry, saturated steam 134 flows out from the separator 112 through one or more nozzles 132 (saturated steam connections) at the top of the separator 112. These saturated steam connections 132, in turn, convey the saturated steam 134 to the various steam-cooled circuits, like the boiler roof tubes 140, convection pass side wall enclosures 33, before being superheated to the final steam temperature in the various superheater stages 34, from where it flows to the high pressure turbine.

The saturated water 136, on the other hand, flows along the inner surface of the separator 112, forming a vortex that flows primarily in a downward direction and which mixes at M with the continuously supplied subcooled (below saturation) feedwater 24 from the economizer (not shown). With the formation of the vortex, a small portion of the water will move up the inner surface to the stripper ring 135. The stripper ring 135 is used to contain the upward movement of the water 136 from reaching scrubber 133. The water mixture created through intense mixing of the feedwater 24 with the separated saturated water 136 is still subcooled and this water column still rotates due to the tangential motion of the saturated water imparted by the nozzles 122. A vortex inhibitor 138 at the bottom of the vessel 112 prevents this rotation to continue as the water flows into and down through the downcomer 14. A rotating fluid column could cause maldistribution of flow to the various furnace circuits connected to the downcomer 14 and limit the fluid transfer capability of the downcomer 14.

It is important to control the water level in the separator vessel to stay within a certain range H, typically several feet up and down from a set level. This will prevent water from being carried over into the steam flow at the top of the separator 112, which could damage the steam superheating surfaces 34 downstream through water shock and carried over impurities, and steam from being carried under into the water flow headed into the downcomer 14, which would lighten the water column (reduced static pressure or pumping head) and increase the enthalpy (eat content) of the water, leading to premature boiling and an increased percentage of steam in the steam-water mixture in the furnace circuits 18. The latter would be detrimental to cooling of the furnace circuits, especially in connection with a reduced pumping head. Thus, larger separators 112 achieve the separating function that is conventionally assumed by a drum with many small centrifugal separators.

Figure 7:
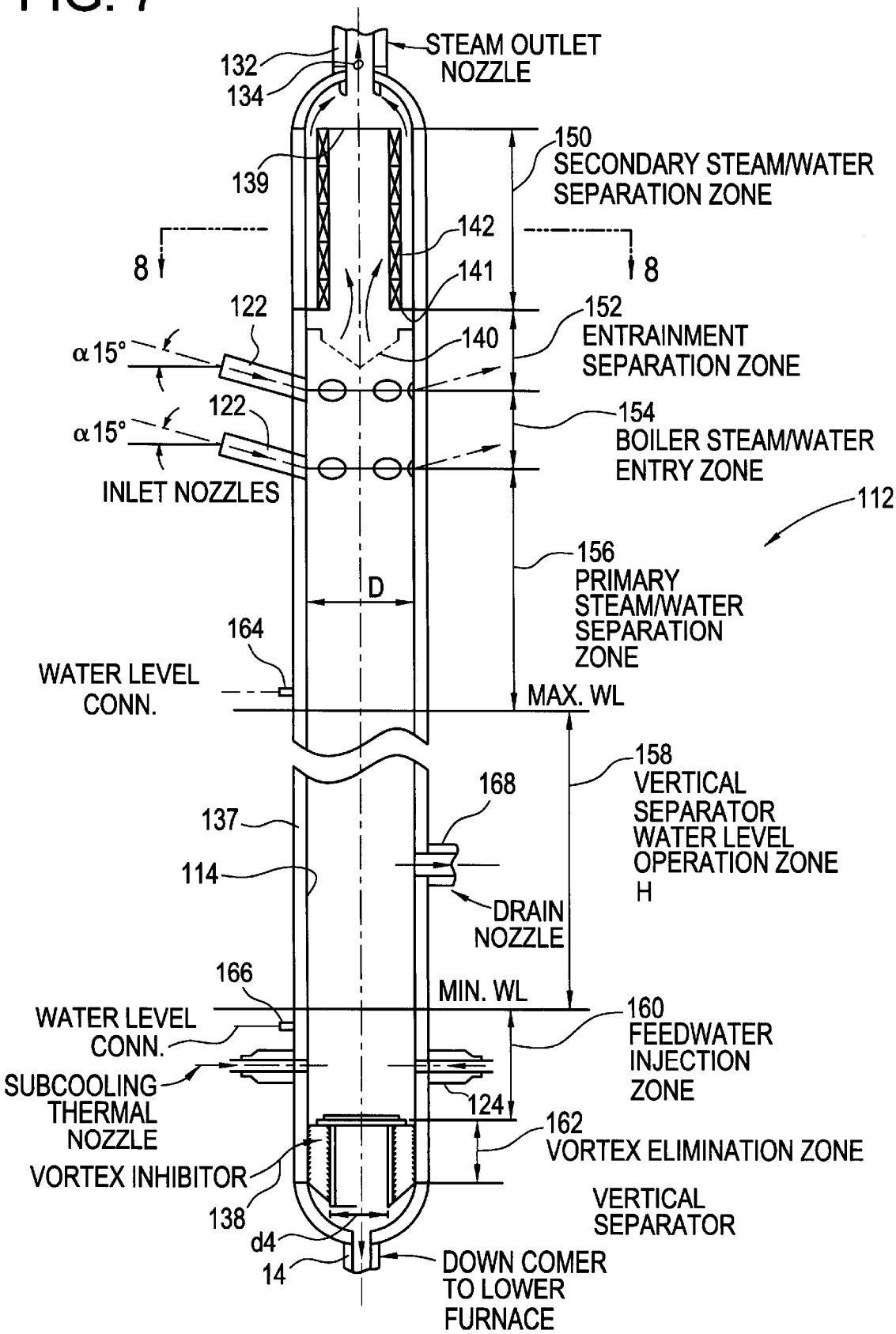
FIG. 7 is a sectional side view of another embodiment of the vertical steam/water separator according to the present invention.
Figure 8:
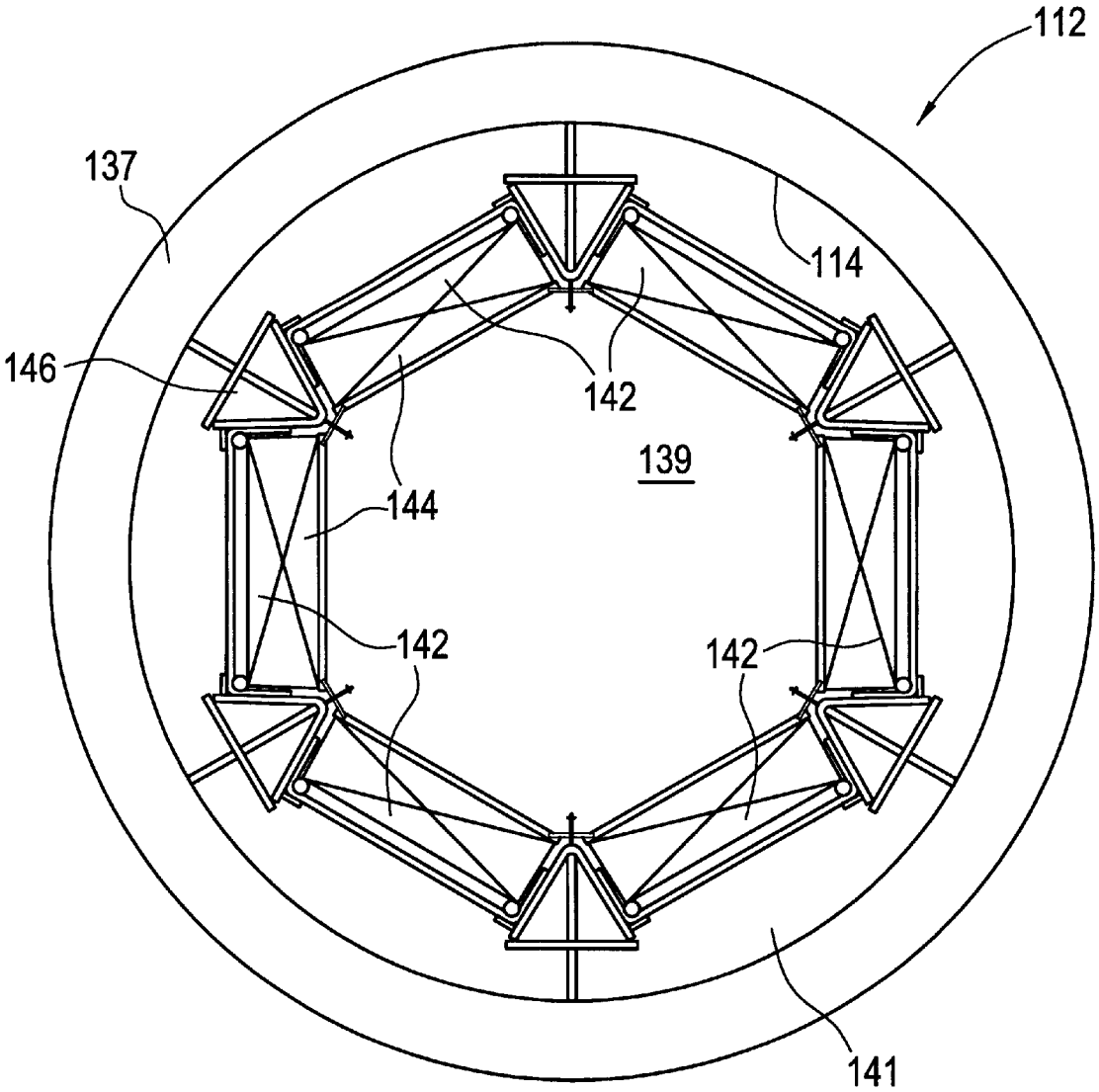
FIG. 8 is a sectional plan view of the vertical steam/water separator of FIG. 7, viewed in the direction of arrows 8—8.

FIGS. 7 and 8 illustrate another embodiment of the vertical steam/water separator 112 according to the present invention. From a structural, as well as functional perspective, this embodiment employs many of the features of the embodiment illustrated in FIG. 4, and thus these common features will not be described again in detail. It is important to note, however, that the embodiment of FIGS. 7 and 8 employs a slightly different form of stripper ring, designated 140, and a completely different scrubber 142 arrangement. The stripper ring 140 in this embodiment again extends around the inside perimeter or circumference of the wall 137 of the separator 112, just above the location where the one or more levels of tangential nozzles 122 connect to the separator 112. As shown, the stripper ring 140 may have a solid, annular portion adjacent the inside of the wall 137, and a conical, perforated portion in the center region of the separator 112. Steam can pass through the perforations in the scrubber ring 140, while water removed by the scrubbers 142 from the steam prior to its departure from the separator 112 can drain back down into a lower portion of the separator 112. The solid annular portion of the stripper ring 140 adjacent the inside surface of the wall 137 is used to contain the upward movement of water 136 from reaching that portion of the separator 112 where secondary steam/water separation takes place.

Notably, in the embodiment of FIGS. 7 and 8, the scrubbers 142 comprise an array of vertically oriented individual scrubber elements 144 arranged around the inside perimeter of the separator 112, spaced from the inside surface of the wall 137 of the separator 112 so as to create a substantially open, annular region 146 therebetween. It will be noted that the center portion 139 of the scrubber 133 is closed off so that the steam must pass through the scrubber 133. Likewise, the bottom end of the scrubber 133 is provided with a ring 141 extending between the scrubber 133 and the inside surface of the wall 137 of the separator 112. Both of these features ensure that the steam is conveyed through the scrubber 133. Thus, as the steam passes up into the top portion of the separator 112, it makes a gradual turn across and through these scrubber elements 144 comprising scrubber 142 and thence out of the separator 112 via nozzle 132. Supports 146 are provided to secure the individual scrubber elements 144 to the inside of the separator 112. "The individual scrubber elements 144 may be sized so as to permit removal and inspection as required through conventional access openings. While FIG. 8 illustrates six (6) sets of scrubber elements 144, fewer or greater numbers could be employed, again as required by the amount of steam that must be scrubbed by a given separator 112. Further, it is preferred that the individual scrubber elements 144 are oriented so that, for example, the chevron-type plate elements are substantially vertical so that any collected moisture runs down along the plates, in contrast with a chevron-type plate arrangement where the plates are essentially horizontal. The latter would not be preferred because any water removed from the steam could have a greater tendency to lay on the plates and be swept out and into the saturated connections 132, which is undesirable."

Returning to FIG. 7, from a functional viewpoint the separator 112 may be considered to have several zones along its height, each having or defining a particular function. Starting at the top, the secondary steam/water separation zone 150 is where the final moisture is removed from the steam. The height of the individual vertical scrubber elements 144 comprising the scrubber 142 determines the extent of this zone 150. Below zone 150, an entrainment separation zone 152 encompasses the region from the bottom of the scrubber 142 to the top level of nozzles 122, and includes the scrubber ring device 140. The region where the tangential nozzles 122 are connected to and provide the steam/water mixture into the separator 112 may be defined as the boiler steam/water entry zone 154, and is the next lower zone.

The majority of the separation of the steam from the water takes place in the primary steam/water separation zone 156, as the water spirals downwardly to the bottom of the separator 112. Below that zone 156 is the region which will be substantially filled with water, albeit with a fluctuating water level, during steam generator 100 operation, and this zone is designated the vertical separator water level operation zone, which defines the normal water level operation range. It has a height H of several feet, perhaps 6–12 feet, and upper 164 and lower 166 water level connections are provided for instrumentation to ensure proper separator 112 operation. A drain nozzle 168 may be provided in this region if desired.

Below the zone 158 is what is referred to as the feedwater injection zone 160, and comprises the area where feedwater 24 is introduced into the separator 112 for mixing with the separated water 136. Finally, a lower vortex elimination zone is defined as the region below zone 160 downwards to the downcomer 14, and which contains any vortex inhibitor devices 138 as described above.

The main benefits of larger individual separators 112 according to the present invention over a conventional, single, large steam drum are the following:

1. Drastic reduction in overall weight. The separators 112 according to the present invention typically have a 30" inside diameter D, a wall 137 thickness of approximately 3", and a height of approximately 30', as compared with conventional steam drums which typically have a 72" inside diameter, a wall thickness of 6" to 7", and lengths up to 100'. Of course, the exact dimensions of a separator 112 for a specific application would be determined on a case-by-case basis.
2. Vertical separators 112 attached to straight downcomers 14 can be arranged anywhere along the periphery of a furnace 28, are easy to erect, and can be erected at any time during the boiler construction. A drum must be erected immediately after the boiler support frame is erected, which places it on the critical path of a drum boiler project. The overall lead time for a system with vertical separators 112 is, therefore, considerably less than the lead time for a system with a drum.

3. The cost of a natural or pump-assisted circulation system with vertical separators 112 is considerably less than an equivalent circulation system involving a drum.

There are no real disadvantages to a drumless boiler design. The individual components of such a system constitute proven technology, combined in a new way to provide an economical, streamlined design, especially if applied to larger size, high-pressure steam generators.

While a specific embodiment of the invention has been shown and described in detail to illustrate the application of the principles of the invention, it will be appreciated by those skilled in the art that changes may be made in the form of the invention covered by the following claims without departing from such principles. For example, the principles of the present invention can be applied to new steam generator construction, as well as in retrofit applications involving the repair, modification, conversion, and/or replacement of existing steam generators, whether of a natural or pump-assisted circulation type, or of the once-through steam generator type. In some embodiments of the invention, certain features of the invention may sometimes be used to advantage without a corresponding use of the other features. Accordingly, all such changes and embodiments properly fall within the scope and equivalents of the following claims.

We claim:

1. A drumless natural circulation boiler system, comprising:

a furnace enclosure having wall tubes;

upper and lower headers connected to respective upper and lower ends of the wall tubes;

at least one vertical steam/water separator;

riser means connected between the upper headers and the separator for returning a steam/water mixture to the separator, the riser means being connected to the separator for swirling the steam/water mixture in the separator for separating steam from water in the separator;

saturated steam connection means connected to the separator for conveying saturated steam therefrom;

a downcomer connected to the separator for conveying water from the separator; and supply means connected between the downcomer and the lower headers for conveying water thereto.

2. The drumless natural circulation boiler system according to claim 1, wherein the vertical steam/water separator comprises a vertically extending cylindrical vessel.

3. The drumless natural circulation boiler system according to claim 1, comprising a feedwater conduit connected to the vertical steam/water separator for supplying feedwater to the separator.

4. A drumless natural circulation boiler system, comprising:

a furnace enclosure having wall tubes;

upper and lower headers connected to respective upper and lower ends of the wall tubes;

at least one vertical steam/water separator including an array of vertically oriented individual scrubber elements arranged around an inside perimeter of the separator;

riser means connected between the upper headers and the separator for returning a steam/water mixture to the separator, the riser means being connected to the separator for swirling the steam/water mixture in the separator for separating steam from water in the separator;

saturated steam connection means connected to the separator for conveying saturated steam therefrom;

a downcomer connected to the separator for conveying water from the separator; and supply means connected between the downcomer and the lower headers for conveying water thereto.

5. The drumless natural circulation boiler system according to claim 4, wherein the individual scrubber elements are spaced from an inside surface of a wall of the separator so as to create a substantially open annular region therebetween.

6. The drumless natural circulation boiler system according to claim 4, comprising tangential nozzle means connected to the separator below the array of vertically oriented scrubber elements for receiving the steam/water mixture from the riser means.

7. The drumless natural circulation boiler system according to claim 4, wherein the wall tubes of the furnace enclosure comprise internally ribbed tubes.

8. A vertical steam/water separator, comprising:

a vertically extending cylindrical vessel having a top and a bottom portion;

means for providing a steam/water mixture to the vessel for swirling the steam/water mixture in the separator for separating steam from water in the separator;

vertically oriented scrubber means for removing water from steam, located in the top portion of the vessel and arranged around an inside circumference of the separator;

saturated steam connection means for conveying saturated steam from the vessel;

feedwater supply means connected through a wall of the separator for conveying feedwater to the vessel; and means for conveying the feedwater and water separated from the steam from the vessel.

9. The steam/water separator according to claim 8, wherein the scrubber means comprises an array of vertically oriented individual scrubber elements arranged around the inside circumference of the separator, spaced from the inside surface of the wall of the separator so as to create a substantially open, annular region therebetween.

10. A vertical steam/water separator, comprising:

a vertically extending cylindrical vessel having a top and a bottom portion;

at least one level of tangentially oriented nozzles connected to a wall of the vessel for providing a steam/water mixture to the vessel for swirling the steam/water mixture in the separator for separating steam from water in the separator;

vertically oriented scrubber means for removing water from steam, located in the top portion of the vessel and arranged around an inside circumference of the separator;

saturated steam connection means for conveying saturated steam from the vessel;

feedwater supply means connected for conveying feedwater to the vessel; and means for conveying the feedwater and water separated from the steam from the vessel.

11. The steam/water separator according to claim 10, wherein the tangentially oriented nozzles are inclined downwardly at an angle with respect to the horizontal direction.

12. The steam/water separator according to claim 10, comprising plural levels of inclined, tangentially oriented nozzles connected to the wall of the vessel, the nozzles of one level being staggered with respect to the nozzles of an adjacent level so as to avoid interference between jets of steam/water being conveyed by the nozzles from various levels.

13. A vertical steam/water separator, comprising:

a vertically extending cylindrical vessel having a top and a bottom portion;

means for providing a steam/water mixture to the vessel for swirling the steam/water mixture in the separator for separating steam from water in the separator;

vertically oriented scrubber means for removing water from steam, located in the top portion of the vessel and arranged around an inside circumference of the separator;

a stripper ring positioned within the vessel below the scrubber means and above at least one level of tangentially oriented nozzles connected to a wall of the vessel for providing a steam/water mixture to the vessel for swirling the steam/water mixture in the separator for separating steam from water in the separator;

saturated steam connection means for conveying saturated steam from the vessel;

feedwater supply means connected for conveying feedwater to the vessel; and means for conveying the feedwater and water separated from the steam from the vessel.

14. The steam/water separator according to claim 13, wherein the stripper ring has a solid, annular portion adjacent an inside surface of the vessel and a conical, perforated portion in the center region of the separator.

15. A vertical steam/water separator, comprising:

a vertically extending cylindrical vessel having a top and a bottom portion;

means for providing a steam/water mixture to the vessel for swirling the steam/water mixture in the separator for separating steam from water in the separator;

vertically oriented scrubber means for removing water from steam, located in the top portion of the vessel and arranged around an inside circumference of the separator;

saturated steam connection means for conveying saturated steam from the vessel;

feedwater supply means connected for conveying feedwater to the vessel;

vortex inhibitor means for reducing rotation of the feedwater and water as it is conveyed from the vessel; and means for conveying the feedwater and water separated from the steam from the vessel.

16. A steam/water separator for a boiler for receiving feedwater and a steam/water mixture, separating the steam from the water, conveying the separated steam from the separator, and mixing the feedwater with the separated water and conveying same from the separator, comprising:

a vertically extending cylindrical vessel having a top and a bottom portion and defining a plurality of zones therein, said zones including;

a secondary steam/water separation zone having scrubber means for removing a final portion of water from the steam;

an entrainment separation zone, located below the scrubber means and above a boiler steam/water entry zone, which provides the steam/water mixture into the separator via a plurality of inclined tangential nozzles;

a primary steam/water separation zone, located below the boiler steam/water entry zone, where water spirals downwardly to the bottom of the separator;

a vertical separator water level operation zone, located below the primary steam/water separation zone, which will be substantially filled with water having a fluctuating water level, during boiler operation;

a feedwater injection zone, located below the vertical separator water level zone, where the feedwater is introduced into the separator for mixing with the separated water; and a lower vortex elimination zone, located below the feedwater injection zone, for reducing rotation of the feedwater and water as it is conveyed from the separator.

* * * * *